United States Patent [19]

Des Gaines

[11] 4,248,128

[45] Feb. 3, 1981

[54] GUITAR PICK ARRAY

[76] Inventor: Laurence Des Gaines, 2027 Natalie Blvd., Seaford, N.Y. 11703

[21] Appl. No.: 53,332

[22] Filed: Sep. 28, 1979

[51] Int. Cl.[3] ..... G10D 3/16

[52] U.S. Cl. ..... 84/322; D17/20

[58] Field of Search ..... 84/320–322; D17/20

[56] References Cited

U.S. PATENT DOCUMENTS

| | | | |
|---|---|---|---|
| 768,241 | 8/1904 | Seidel | 84/322 |
| 2,221,234 | 11/1940 | Frasier | 84/322 |
| 3,304,826 | 2/1967 | Caron | 84/322 |
| 3,312,137 | 4/1967 | Oddo | 84/322 |

*Primary Examiner*—Lawrence R. Franklin

*Attorney, Agent, or Firm*—Blum, Kaplan, Friedman, Silberman & Beran

[57] ABSTRACT

A guitar pick array comprises a plurality of guitar picks mounted in a handle so that the guitar picks are parallel to each other and spaced apart. The array is tapered, the tips of the guitar picks lying along either a single line or two lines making an angle with each other.

Drawing the array across the strings of a guitar results in the production of a tone which differs substantially from and is substantially more pleasant than the tone produced by a single pick.

10 Claims, 2 Drawing Figures

GUITAR PICK ARRAY

BACKGROUND OF THE INVENTION

Guitars, usually having six strings, are conventionally played with a single pick. The intensity of the tone produced by plucking one or more strings with the pick can be varied. However, the tone produced cannot be varied in quality in a manner similar to that of the bowed strings of a member of the violin family. Whereas the violin strings can be made to generate a number of different sounds which can readily be identified with the manner of bowing, or even plucking, the tone of the guitar has been limited completely to that produced by plucking. The mechanics of producing the tone is simple, the pick pulling a string asymmetrically away from rest position and then releasing the string to vibrate. The musical note is generated by the vibration which occurs after the pick has released the string so that there is no way in which the tone can be influenced when only a single pick is used, as has been customary. The present invention is intended to make it possible to produce a substantially different tone from that produced by the single pick, said tone also being considered an improvement over that produced by the single pick.

SUMMARY OF THE INVENTION

A guitar pick array in accordance with the present invention comprises a plurality of individual guitar picks, each pick having a tip and a base. The bases of the guitar picks are mounted in a handle for holding the picks so that the planes thereof are parallel to each other with the planes being spaced apart by from 0.7 mm to 2.5 mm. The picks are held in the handle so that the tips thereof lie along a line making an angle of some 30° to 60° with the planes of said picks. The picks may lie along a single line or along two lines making an angle of from 75° to 105° with each other. The handle may be of a curable resin such as epoxy or of wood, one end of the handle being slotted to receive the picks. The handle may also be made of a metal such as magnesium or aluminum. The picks may be held in the slots of the handle by means of pins or rivets or screws passing through the bases of the picks and through the handle.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
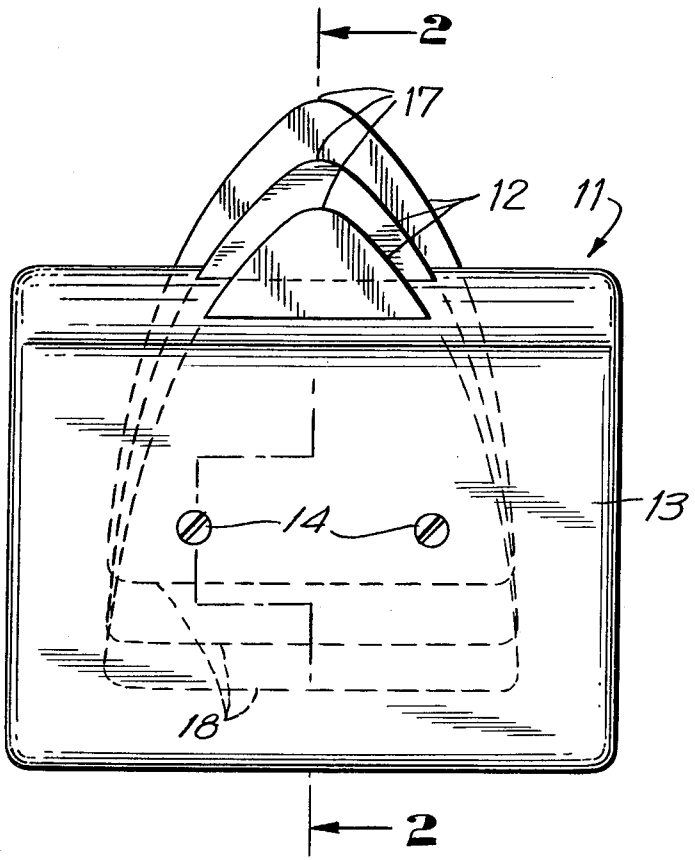
FIG. 1 is a front view of a guitar pick array in accordance with the present invention.

FIG. 1 shows a guitar pick array indicated generally by the reference numeral 11, said guitar pick array consisting of a plurality of individual guitar picks 12 set into a handle 13. The handle may be of a cured resin such as epoxy, wood or a metal preferably aluminum or magnesium. Where the handle is of a cured resin, the resin will hold the picks tightly in place. Where the handle is of wood or of a metal it is desirable that the individual picks be held firmly in place by pins, rivets or screws as shown at 14 in the Figs. As shown in FIG. 2, the picks are held in place by screws 14 which pass through the handle and through the individual picks and are secured by nuts 16.

Each of the individual picks has a rounded tip 17 and a base 18 as shown in FIG. 1.

Figure 2:
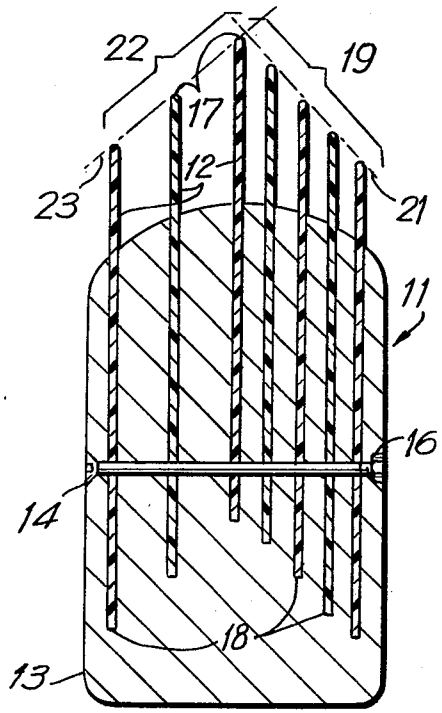
FIG. 2 is a view taken along line 2—2 of FIG. 1, both Figs. being in enlarged scale.

As more clearly shown in FIG. 2, the tips of the picks indicated by the reference numeral 19 and the brace associated therewith lie along a line 21, said line making an angle between 30° and 60° with the planes of the tips. If desired, the tips of the picks may lie along a single line. Preferably, however, the pick tips lie along two lines, the tips indicated by the brace 22 lying along line 23, the angle between line 23 and the planes of the picks being between 30° and 60°. Also, lines 21 and 23 should form an angle lying between about 75° and 105°. The distance between the picks should be between 0.7 mm and 2.5 mm. In the embodiment shown in FIG. 2, the pitch distance between the picks indicated by brace 19 is about 1 mm and the pitch distance between the picks indicated by the brace 22 is about 2 mm. The difference in the spacing between the picks makes it possible to generate tones of somewhat different quality by a selection of the group of picks to be drawn across the strings.

As is evident, there must be at least two picks with tips lying along a single line to generate a tone different from that of a single pick. The number of picks in an array can vary from two to about ten though there is no sharp limit on the upper end of the range. Also, the picks should protrude from the upper end of the handle as shown in the Figs. by from 4 to 8 mm, protrusion by this amount providing the requisite balance between flexibility of the pick and rigidity of the pick. The number of picks, as shown in FIG. 2, is preferably seven with the spacing as aforenoted.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. Guitar pick array for producing an improved tone from a guitar, comprising a plurality of spaced-apart individual planar picks, each of said individual picks having a tip and a base, and handle means having a receiving end, the base of each of said individual picks being held in said receiving end with the planes of said picks parallel to each other and said tips lying along two lines making an angle of about 75° to 105° with each other and each of said lines making an angle of from 30° to 60° with the planes of said picks.

2. The guitar pick array as claimed in claim 1, wherein said picks are from about 0.7 to 2.5 mm apart.

3. The guitar pick array as claimed in claim 1, wherein said picks protrude from said receiving end by from 4 to 8 mm.

4. The guitar pick array as claimed in claim 1, wherein said picks whose tips lie along the first of said lines are about 1 mm apart and said picks whose tips lie along the second of said lines are spaced about 2 mm apart.

5. The guitar pick array as claimed in claim 4, wherein the number of picks whose tips lie along said first line is 5 and the number of picks whose tips lie along said second line is 3, one of said picks being at the junction of said lines and thus being counted twice, the total number of said picks being 7.

6. The guitar pick array as claimed in claim 1, wherein said handle means is a cured resin.

7. The guitar pick array as claimed in claim 1, wherein said handle means is of wood and is slotted at said receiving end for reception and retention of said bases of said picks.

8. The guitar pick array as claimed in claim 1, wherein said handle means is of metal and is slotted for reception and retention of said bases of said picks.

9. The guitar pick array as claimed in claim 1, wherein said metal is selected from the group consisting of magnesium or aluminum.

10. The guitar pick array as claimed in claims 7, 8 or 9, wherein said picks and said handle are apertured and further comprising fastening means passing through said apertures for securing said picks in said slots in said handle.

* * * * *